US011572880B2

(12) United States Patent
Vlastuin et al.

(10) Patent No.: US 11,572,880 B2
(45) Date of Patent: Feb. 7, 2023

(54) CENTRIFUGAL TURBO-COMPRESSOR HAVING A GAS FLOW PATH INCLUDING A RELAXATION CHAMBER

(71) Applicant: Danfoss A/S, Nordborg (DK)

(72) Inventors: Jonathan Vlastuin, Trévoux (FR); Stan Vandesteene, Trévoux (FR); Patrice Bonnefoi, Saint Didier au Mont d'or (FR)

(73) Assignee: Danfoss A/S, Nordborg (DK)

( * ) Notice: Subject to any disclaimer, the term of this patent is extended or adjusted under 35 U.S.C. 154(b) by 212 days.

(21) Appl. No.: 16/663,821

(22) Filed: Oct. 25, 2019

(65) Prior Publication Data

US 2020/0132079 A1 Apr. 30, 2020

(30) Foreign Application Priority Data

Oct. 29, 2018 (FR) ..... 18/59978

(51) Int. Cl.
*F04D 17/12* (2006.01)
*F04D 29/42* (2006.01)
(Continued)

(52) U.S. Cl.
CPC ..... *F04D 17/122* (2013.01); *F04D 29/4206* (2013.01); *F04D 25/06* (2013.01);
(Continued)

(58) Field of Classification Search
CPC .... F04D 17/122; F04D 29/4206; F04D 25/06; F04D 29/4213; F04D 29/441; F04D 29/624; F04D 17/12; F04D 29/667
See application file for complete search history.

(56) References Cited

U.S. PATENT DOCUMENTS 3,941,499 A 3/1976 Kronogard
6,709,243 B1 * 3/2004 Tan ..... F01D 1/12 415/55.1
(Continued)

FOREIGN PATENT DOCUMENTS

CN 202250938 U 5/2012
CN 106460863 A 2/2017
(Continued)

OTHER PUBLICATIONS

Raw machine translation of WO0075490A1, "Radial turbomachine", Ribaud, 2000.*
(Continued)

*Primary Examiner* — Charles G Freay
*Assistant Examiner* — Lilya Pekarskaya
(74) *Attorney, Agent, or Firm* — McCormick, Paulding & Huber PLLC

(57) ABSTRACT

The centrifugal turbo-compressor (2) includes a hermetic casing (3); a drive shaft (6) having a longitudinal axis and rotatably arranged within the hermetic casing (3); a compression stage including an impeller (17) connected to the drive shaft (6); a gas suction inlet (42); and a gas flow path (P) fluidly connected to the gas suction inlet (42) and configured to supply the compression stage with a gas flow. The gas flow path (P) includes a relaxation chamber (46) at least partially surrounding the drive shaft (6), the gas suction inlet (42) emerging substantially radially into the relaxation chamber (46); and a plurality of inlet flow guide channels (51) fluidly connected to the relaxation chamber (46) and angularly distributed around the longitudinal axis of the drive shaft (6), the inlet flow guide channels (51) extending radially towards the drive shaft (6) and being axially offset from the gas suction inlet (42) and the relaxation chamber (46).

19 Claims, 3 Drawing Sheets

(51) Int. Cl.
*F04D 29/44* (2006.01)
*F04D 29/62* (2006.01)
*F04D 25/06* (2006.01)

(52) U.S. Cl.
CPC ..... *F04D 29/4213* (2013.01); *F04D 29/441* (2013.01); *F04D 29/624* (2013.01)

(56) References Cited

U.S. PATENT DOCUMENTS

| | | | | |
|---|---|---|---|---|
| 8,287,236 | B2 * | 10/2012 | Nishida | F04D 29/444 415/199.2 |
| 10,036,582 | B2 * | 7/2018 | Thornton | F25B 31/006 |
| 2002/0141888 | A1 | 10/2002 | Bostwick | |
| 2011/0311356 | A1 * | 12/2011 | Masutani | F04D 29/4213 415/203 |
| 2012/0224955 | A1 * | 9/2012 | Vine | F04D 17/122 415/208.1 |
| 2018/0291802 | A1 * | 10/2018 | Parker | F01D 17/143 |
| 2019/0285072 | A1 * | 9/2019 | Masutani | F04D 17/12 |

FOREIGN PATENT DOCUMENTS

| | | | | | |
|---|---|---|---|---|---|
| EP | 2402618 | A1 | | 1/2012 | |
| GB | 1393955 | | | 5/1975 | |
| JP | 2007309154 | A | * | 11/2007 | F04D 17/122 |
| JP | 2007309154 | A | | 11/2007 | |
| JP | 2017-180096 | A | | 10/2017 | |
| WO | WO-0075490 | A1 | * | 12/2000 | F04D 29/442 |

OTHER PUBLICATIONS

Raw machine translation of JP2007309154, "Single-Shaft Multi-Stage Centrifugal Compressor", Kobayashi et al., 2007.*

Extended European Search Report for Serial No. 19201420.7 dated Mar. 6, 2020.

Communication for European Patent Application Serial No. 19201420.7 dated May 9, 2022.

* cited by examiner

CENTRIFUGAL TURBO-COMPRESSOR HAVING A GAS FLOW PATH INCLUDING A RELAXATION CHAMBER

CROSS-REFERENCE TO RELATED APPLICATION

This application claims foreign priority benefits under 35 U.S.C. § 119 to French Patent Application No. 18/59978 filed on Oct. 29, 2018, the content of which is hereby incorporated by reference in its entirety.

TECHNICAL FIELD

The present invention relates to a centrifugal turbo-compressor.

BACKGROUND

As known, a double-stage centrifugal turbo-compressor notably includes:

- a hermetic casing,
- a drive shaft rotatably arranged within the hermetic casing and extending along a longitudinal axis,
- a first impeller and a second impeller connected to the drive shaft, the first and second impellers being arranged in a back-to-back configuration,
- a gas suction inlet extending tangentially with respect to the longitudinal axis of the drive shaft, and
- an inlet distributor configured to supply the first impeller with a gas flow, the inlet distributor having an annular disc shape and surrounding the drive shaft, the inlet distributor including inlet flow guide members angularly distributed around the longitudinal axis of the drive shaft and partially defining inlet flow guide channels fluidly connected to the gas suction inlet and extending radially towards the drive shaft.

During operation, a gas flow, flowing out the gas suction inlet, comes tangentially into an annular chamber internally defined by the inlet distributor, and then flows around an outer surface of the inlet distributor before entering the inlet flow guide channels and flowing radially through the inlet flow guide channels. The gas flow coming out the respective inlet flow guide channels is then axially supplied to the first impeller.

Due to said configuration of the gas suction inlet and the inlet distributor, the various gas flows flowing through the various inlet flow guide channels are not uniform and homogeneous, which induces a lot of flow distortions through the inlet distributor and a non-homogeneous flow distribution along a circumferential direction at the fluid inlet of the first impeller.

Such a non-homogeneous flow distribution induces a flow variation seen by each impeller blade over its rotation, and thus strongly impacts the surge limit of the compressor and the compressor efficiency.

SUMMARY

It is an object of the present invention to provide an improved centrifugal turbo-compressor which can overcome the drawbacks encountered in conventional centrifugal turbo-compressor with tangential gas suction inlet.

Another object of the present invention is to provide a centrifugal turbo-compressor which is reliable and easy to manufacture, while having an improved efficiency.

According to the invention such a centrifugal turbo-compressor includes:

- a hermetic casing,
- a drive shaft having a longitudinal axis and rotatably arranged within the hermetic casing,
- a compression stage including an impeller connected to the drive shaft,
- a gas suction inlet,
- a gas flow path fluidly connected to the gas suction inlet and configured to supply the compression stage with a gas flow, wherein the gas flow path includes:

- a relaxation chamber at least partially surrounding the drive shaft, the gas suction inlet emerging substantially radially into the relaxation chamber, and
- a plurality of inlet flow guide channels fluidly connected to the relaxation chamber and angularly distributed around the longitudinal axis of the drive shaft, the inlet flow guide channels extending radially towards the drive shaft and being axially offset from the gas suction inlet and the relaxation chamber.

Due to the presence of the relaxation chamber and the fact that the gas suction inlet emerges substantially radially into the relaxation chamber, the gas flow, coming out of the gas suction inlet, flows through the relaxation chamber at low speed, which substantially minimizes the pressure losses at the inlet of the gas flow path and substantially minimizes the flow distortions through the inlet flow guide channels. This results in a more homogenous flow distribution along a circumferential direction at the fluid inlet of the first impeller.

Consequently, such a configuration of the gas flow path and of the gas suction inlet, substantially improves the compressor efficiency, while enabling an easy manufacturing of the turbo-compressor.

The centrifugal turbo-compressor may also include one or more of the following features, taken alone or in combination.

According to an embodiment of the invention, the centrifugal turbo-compressor is a double-stage centrifugal turbo-compressor.

According to an embodiment of the invention, the centrifugal turbo-compressor is a single-stage centrifugal turbo-compressor.

According to an embodiment of the invention, the gas flow path is configured to supply the compression stage with a refrigerant flow.

According to an embodiment of the invention, the relaxation chamber and the drive shaft extend coaxially.

According to an embodiment of the invention, the relaxation chamber extends around the drive shaft along an angular sector lower than 360°.

According to an embodiment of the invention, the centrifugal turbo-compressor further includes a separating wall part located opposite the gas suction inlet and configured such that the relaxation chamber includes a first arcuate chamber part extending from the gas suction inlet to the separating wall part along a first angular direction with respect to the longitudinal axis of the drive shaft and a second arcuate chamber part extending from the gas suction inlet to the separating wall part along a second angular direction with respect to the longitudinal axis of the drive shaft which is opposite of the first angular direction. Such a configuration of the relaxation chamber further reduces the flow distortions through the inlet flow guide channels and thus provides a further more homogenous angular flow distribution at the fluid inlet of the first impeller, which further improves the compressor efficiency.

According to an embodiment of the invention, the first and second arcuate chamber parts extend on both side of the longitudinal axis of the drive shaft.

According to an embodiment of the invention, the relaxation chamber has a horseshoe-shaped cross sectional profile.

According to an embodiment of the invention, an axial length of the relaxation chamber is higher than an inlet diameter of the gas suction inlet.

According to an embodiment of the invention, the relaxation chamber has an outer diameter and an inner diameter which respect the following equation: $OD^2-ID^2>2*D1$, where OD is the outer diameter of the relaxation chamber, ID is the inner diameter of the relaxation chamber, and D1 is the inlet diameter of the gas suction inlet.

According to an embodiment of the invention, the relaxation chamber has a substantially constant cross section along the longitudinal axis of the drive shaft.

According to an embodiment of the invention, the relaxation chamber has a substantially constant radial dimension along the entire circumference of the relaxation chamber.

According to an embodiment of the invention, the inlet flow guide channels have substantially identical widths.

According to an embodiment of the invention, the inlet flow guide channels have substantially identical axial dimensions.

According to an embodiment of the invention, the gas flow path further includes a connecting channel extending around the drive shaft and fluidly connecting the relaxation chamber with the inlet flow guide channels.

According to an embodiment of the invention, the connecting channel emerges into the relaxation chamber at an outer radial portion of the relaxation chamber so as to define a flow restriction for the gas flow.

According to an embodiment of the invention, the connecting channel is annular.

According to an embodiment of the invention, the connecting channel has an inner diameter which is higher than an inner diameter of the relaxation chamber.

According to an embodiment of the invention, the connecting channel has an outer diameter which is substantially equal to an outer diameter of the relaxation chamber.

According to an embodiment of the invention, the centrifugal turbo-compressor further includes inlet flow guide members at least partially defining the inlet flow guide channels, the inlet flow guide members being angularly distributed around the longitudinal axis of the drive shaft.

According to an embodiment of the invention, the inlet flow guide members are regularly angularly distributed around the longitudinal axis of the drive shaft.

According to an embodiment of the invention, one of the inlet flow guide members is located at a same angular position as the separating wall part while being axially offset from the separating wall part. Such an arrangement of the inlet flow guide members provides a further more homogenous angular flow distribution at the fluid inlet of the first impeller, which further improves the compressor efficiency.

According to an embodiment of the invention, each of the inlet flow guide members has a trailing tip oriented towards the drive shaft.

According to an embodiment of the invention, the connecting channel is configured so as to respect the following equation: $\pi*H*Di<\pi/4*(Do^2-Di^2)$, where H is the height of each inlet flow guide member, Di is the inner diameter of the connecting channel and Do is the outer diameter of the connecting channel.

According to an embodiment of the invention, each of the inlet flow guide members extends radially towards the drive shaft and converges towards the drive shaft.

According to an embodiment of the invention, the inlet flow guide members are arranged such that each pair of adjacent inlet flow guide members defines a respective inlet flow guide channel.

According to an embodiment of the invention, each inlet flow guide member has an airfoil-shaped cross-sectional profile.

According to an embodiment of the invention, each inlet flow guide member has a constant height.

According to an embodiment of the invention, each inlet flow guide member includes a leading edge having a high radius of curvature.

According to an embodiment of the invention, the centrifugal turbo-compressor further includes an inlet distributor having an annular disc shape and surrounding the drive shaft, the inlet flow guide channels being at least partially defined by the inlet distributor. Advantageously, the inlet flow guide members are at least partially provided on the inlet distributor.

According to an embodiment of the invention, the centrifugal turbo-compressor further includes a stationary flow guiding part having an annular disc shape and surrounding the inlet distributor, the inlet flow guide members being at least partially provided on the stationary flow guiding part.

According to an embodiment of the invention, the connecting channel is partially defined by the stationary flow guiding part. Advantageously, the connecting channel is defined by the stationary flow guiding part and by the hermetic casing.

According to an embodiment of the invention, the inlet flow guide members face towards the impeller.

According to an embodiment of the invention, the gas flow path further includes an annular supplying channel extending around the drive shaft and being fluidly connected to the inlet flow guide channels, the annular supplying channel being configured to axially supply the compression stage with the gas flow.

According to an embodiment of the invention, the annular supplying channel is located downstream of the inlet flow guide channels.

According to an embodiment of the invention, the annular supplying channel is internally defined by an annular converging surface which converges towards the compression stage.

According to an embodiment of the invention, the annular supplying channel is provided on a covering part which is secured to the inlet distributor, the covering part extending around the drive shaft and being configured such that the gas flow flowing from the inlet flow guide channels to the impeller does not contact a rotational part, and for example the drive shaft.

According to an embodiment of the invention, the gas suction inlet includes a gas inlet part having a circular cross section, and a gas outlet part including a gas outlet emerging into the relaxation chamber, the gas outlet part diverging towards the relaxation chamber. Such a configuration of the gas suction inlet, and particularly of the gas outlet part, reduces gas speed and so pressure drops at the relaxation chamber inlet.

According to an embodiment of the invention, the gas inlet part extends radially with respect to the longitudinal axis of the drive shaft.

According to an embodiment of the invention, the gas outlet is oblong and extends along a circumferential direction with respect to the longitudinal axis of the drive shaft. Advantageously, the gas outlet has a first dimension taken along the longitudinal axis of the drive shaft and a second dimension taken along the circumferential direction, the second dimension being higher than the first dimension.

According to an embodiment of the invention, the first dimension and the second dimension of the gas outlet respect the following equation: $Do2*Do1>D1^2$, where Do1 is the first dimension of the gas outlet, Do2 is the second dimension of the gas outlet, and D1 is the inlet diameter of the gas suction inlet.

According to an embodiment of the invention, the centrifugal turbo-compressor further includes an additional compression stage including an additional impeller connected to the drive shaft.

According to an embodiment of the invention, each of the impeller and the additional impeller has a front-side and a back-side, the impeller and the additional impeller being arranged in a back-to-back configuration.

According to an embodiment of the invention, the centrifugal turbo-compressor further includes an axial bearing arrangement configured to limit an axial movement of the drive shaft during operation.

According to an embodiment of the invention, the centrifugal turbo-compressor further includes a radial bearing arrangement configured to rotatably support the drive shaft.

According to an embodiment of the invention, the relaxation chamber at least partially surrounds the radial bearing arrangement.

According to an embodiment of the invention, the centrifugal turbo-compressor further includes an electric motor configured to drive in rotation the drive shaft about a rotation axis.

According to an embodiment of the invention, the drive shaft includes a first axial end portion and a second axial end portion opposite to the first axial end portion, the impeller being connected to the first axial end portion of the drive shaft and the electrical motor being connected to the second axial end portion of the drive shaft.

According to an embodiment of the invention, each of the impeller and the additional impeller is connected to the first axial end portion of the drive shaft.

According to an embodiment of the invention, the inlet distributor has a first axial surface facing toward the impeller and a second axial surface facing towards the axial bearing arrangement.

According to an embodiment of the invention, the relaxation chamber is defined by the hermetic casing.

These and other advantages will become apparent upon reading the following description in view of the drawings attached hereto representing, as non-limiting example, one embodiment of a centrifugal turbo-compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

Figure 1:
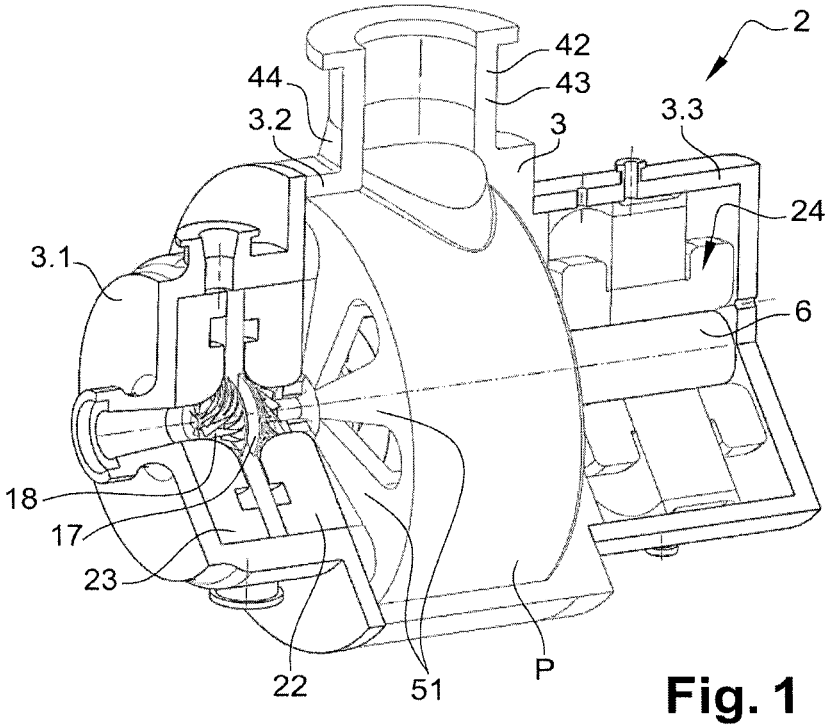
FIG. 1 is a perspective view, partially in section, of a centrifugal turbo-compressor according to a first embodiment of the invention.
Figure 2:
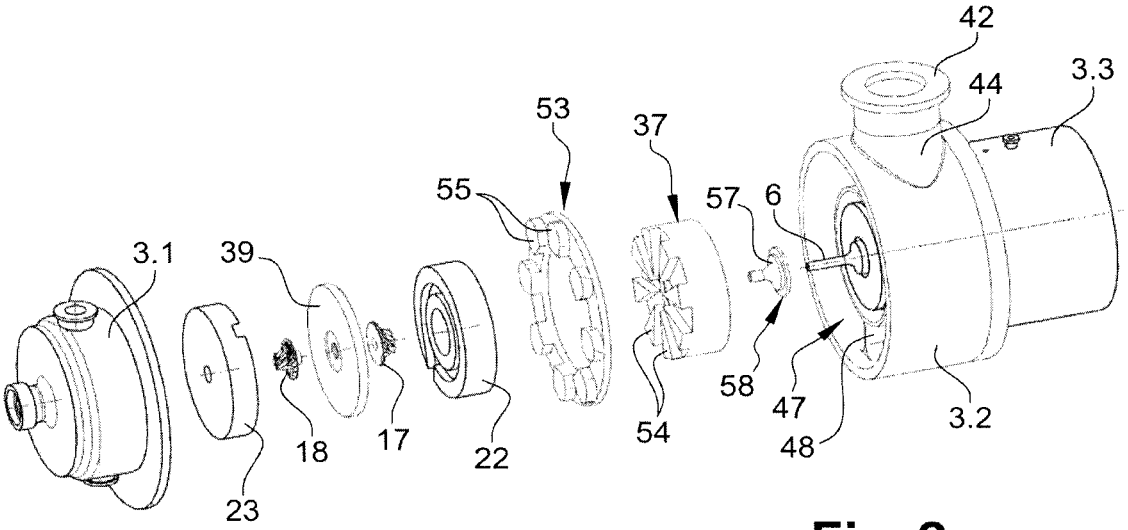
FIG. 2 is an exploded perspective view of the centrifugal turbo-compressor of FIG. 1.
Figure 3:
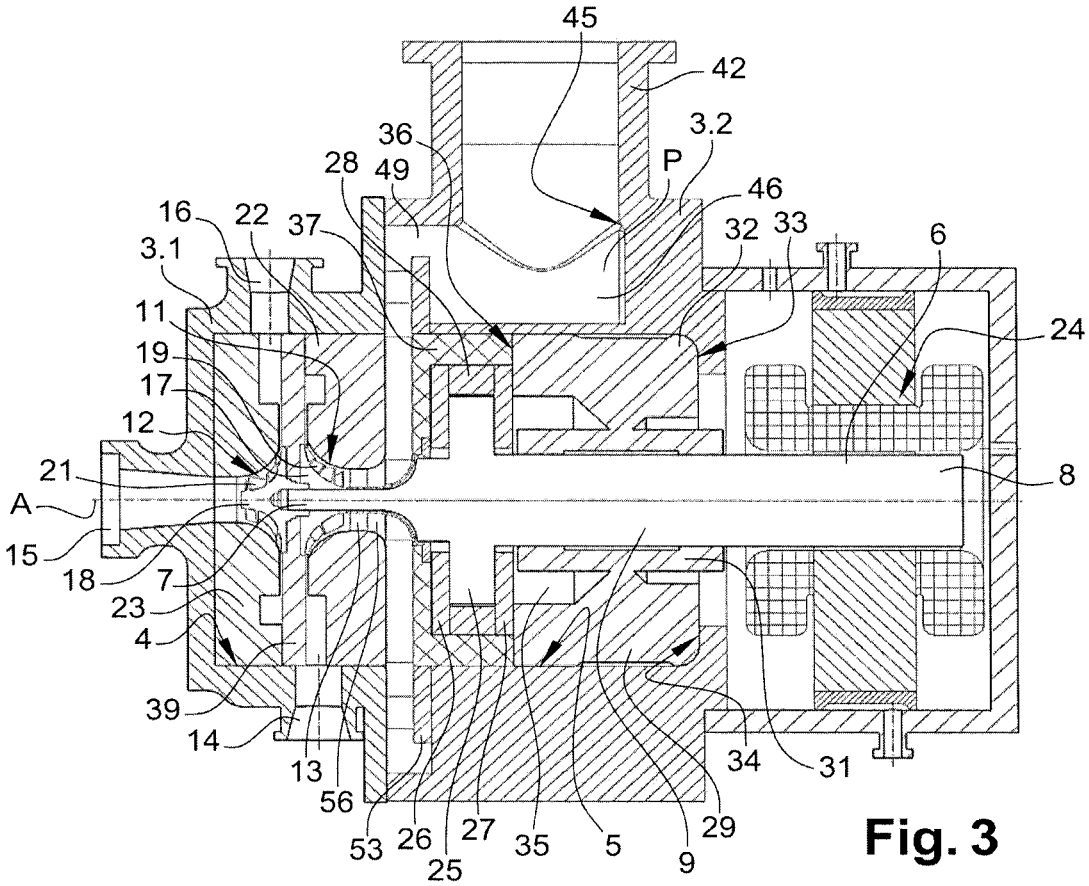
FIG. 3 is a longitudinal section view of the centrifugal turbo-compressor of FIG. 1.
Figure 4:
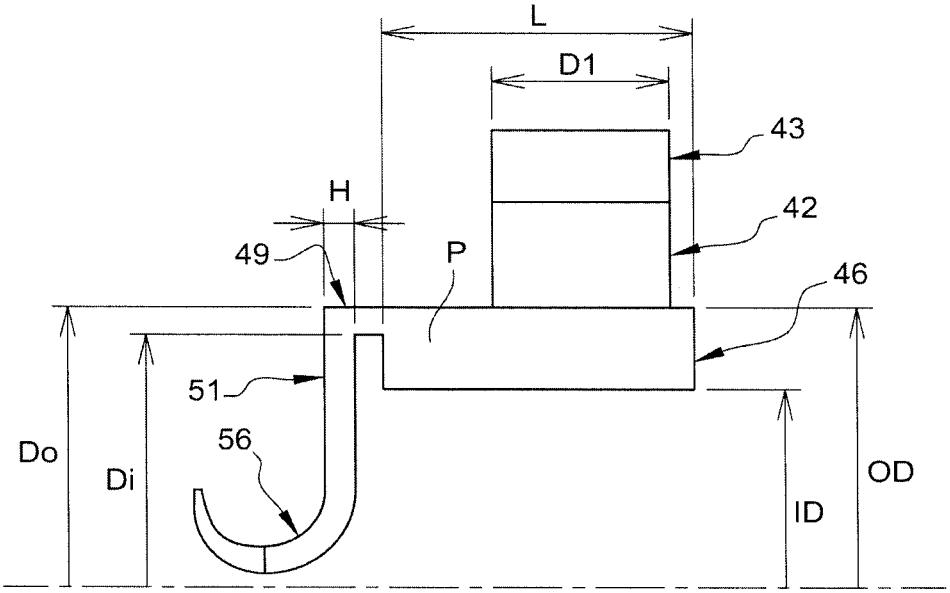
FIG. 4 is a longitudinal section view of a gas flow path of the centrifugal turbo-compressor of FIG. 1.

FIGS. 1 to 6 represent a hermetic centrifugal turbo-compressor 2, and particularly a double-stage hermetic centrifugal turbo-compressor, according to a first embodiment of the invention.

The centrifugal turbo-compressor 2 includes a hermetic casing 3 including an impeller casing portion 3.1, a bearing casing portion 3.2 and a motor casing portion 3.3. As better shown on FIG. 3, the impeller casing portion 3.1 and the bearing casing portion 3.2 respectively include a cylindrical impeller housing 4 and a cylindrical bearing housing 5 which extend coaxially. The impeller casing portion 3.1 and the bearing casing portion 3.2 are secured to each other, for example by screwing or welding.

The centrifugal turbo-compressor 2 also includes a drive shaft 6 rotatably arranged within the hermetic casing 3 and extending along a longitudinal axis A. The drive shaft 6 includes a first axial end portion 7, a second axial end portion 8 opposite to the first axial end portion 7, and an intermediate portion 9 arranged between the first and second end axial portions 7, 8.

The centrifugal turbo-compressor 2 further includes a first compression stage 11 and a second compression stage 12 arranged in the cylindrical impeller housing 4 and configured to compress a gas, and for example a refrigerant. The first compression stage 11 includes a fluid inlet 13 and a fluid outlet 14, while the second compression stage 12 includes a fluid inlet 15 and a fluid outlet 16, the fluid outlet 14 of the first compression stage 11 being fluidly connected to the fluid inlet 15 of the second compression stage 12.

The first and second compression stages 11, 12 respectively include an impeller 17 and an additional impeller 18 which are connected to the first axial end portion 7 of the drive shaft 6 and which extend coaxially with the drive shaft 6. The impeller 17 includes a front-side equipped with a plurality of blades 19 configured to accelerate, during rotation of the drive shaft 6, the gas entering the first compression stage 11, while the additional impeller 18 includes a front-side equipped with a plurality of blades 21 configured to accelerate, during rotation of the drive shaft 6, the gas entering the second compression stage 12. Further each of the impeller 17 and the additional impeller 18 includes a back-side extending substantially perpendicularly to the drive shaft 6.

The impeller and additional impellers 17, 18 are arranged in a back-to-back configuration, so that the directions of fluid flow at the flow inlets 13, 15 of the first and second compression stages 11, 12 are opposite to each other.

Further the first and second compression stage 11, 12 respectively includes a first aerodynamic member 22 and a second aerodynamic member 23 each having an annular disc shape. The first and second aerodynamic members 22, 23 respectively face the front-sides of the impeller 17 and the additional impeller 18. The outer diameters of the first and second aerodynamic members 22, 23 are substantially equal to the inner diameter of the cylindrical impeller housing 4. According to the embodiment shown on FIGS. 1 to 6, the first and second aerodynamic members 22, 23 are axially slidably arranged in the cylindrical impeller housing 4.

The centrifugal turbo-compressor 2 also includes an electric motor 24 connected to the second axial end portion 8 of the drive shaft 6 and configured to drive in rotation the drive shaft 6 about the longitudinal axis A. The electric motor 24 is arranged in the motor casing portion 3.3.

The centrifugal turbo-compressor 2 further includes an axial bearing arrangement, also named thrust bearing arrangement, arranged between the impeller 17 and the electrical motor 24 and configured to limit an axial movement of the drive shaft 6 during operation. The axial bearing arrangement may be a fluid axial bearing arrangement, and for example a gas axial bearing arrangement.

According to the embodiment shown on FIGS. 1 to 6, the axial bearing arrangement includes an axial bearing member 25 arranged on an outer surface of the intermediate portion 9 of the drive shaft 6 and extending radially outwardly with respect to the drive shaft 6.

The axial bearing arrangement also includes a first axial bearing plate 26 and a second axial bearing plate 27 each having an annular disc shape, and being arranged in parallel. The first axial bearing plate 26 faces towards the impeller 17, while the second axial bearing plate 27 faces towards the electrical motor 24.

The axial bearing arrangement further includes a spacer ring 28 surrounding the axial bearing member 25, and being clamped between the first and second axial bearing plates 26, 27 at radial outer portions of the first and second axial bearing plates 26, 27. The spacer ring 28 particularly defines an axial distance between the first and second axial bearing plates 26, 27, said axial distance being slightly greater than the width of the axial bearing member 25.

Advantageously, the centrifugal turbo-compressor 2 is configured so that gas is introduced between the axial bearing member 25, and the first and second axial bearing plates 26, 27 to form a gas axial bearing.

The centrifugal turbo-compressor 2 also includes a radial bearing arrangement configured to rotatably support the drive shaft 6. The radial bearing arrangement includes a bearing sleeve 29, also named bearing housing, which extends around the drive shaft 6 and along the intermediate portion 9 of the drive shaft 6. The bearing sleeve 29 is at least partially arranged in the cylindrical bearing housing 5 and is located between the axial bearing arrangement and the electrical motor 24. The bearing sleeve 29 may be a one-piece bearing sleeve, or may be made from separated parts assembled together.

According to the embodiment shown on FIGS. 1 to 6, the bearing sleeve 29 notably includes:

- a radial bearing part 31 which is tubular and which surrounds the intermediate portion 9 of the drive shaft 6, the radial bearing part 31 being configured to rotatably support the drive shaft 6,
- an outer sleeve part 32 surrounding the radial bearing part 31 and including an axial end face 33 facing towards the electrical motor 24 and abutting against an annular axial bearing surface 34 of the bearing casing portion 3.2, and
- an annular gap 35 formed between the radial bearing part 31 and the outer sleeve part 32 and facing towards the second axial bearing plate 27.

The bearing sleeve 29 further includes an abutment surface 36 against which the second axial bearing plate 27 abuts. The abutment surface 36 is advantageously located at an axial end face of the outer sleeve part 32 facing towards the second axial bearing plate 27, and extends transversally, and advantageously perpendicularly, to the longitudinal axis A of the drive shaft 6. Therefore the bearing sleeve 29 is clamped between the second axial bearing plate 27 and the axial bearing surface 34 of the bearing casing portion 3.2.

The centrifugal turbo-compressor 2 further includes an inlet distributor 37 arranged for example in the cylindrical bearing housing 5 and configured to supply, and for example to axially supply, the first compression stage 11, with gas. The inlet distributor 37 is adjacent to the first aerodynamic member 22, and has an annular disc shape and an outer diameter substantially equal to the inner diameter of the cylindrical bearing housing 5. The inlet distributor 37 is advantageously axially slidably arranged in the cylindrical bearing housing 5.

The centrifugal compressor 2 may further include an elastic element arranged between the impeller casing portion 3.1 and the second aerodynamic member 23. Advantageously, the elastic element is an annular spring washer, for example of the Belleville type, coaxially arranged with the drive shaft 6. The elastic element is for example arranged in an annular recess formed in an axial surface of the impeller casing portion 3.1.

According to an embodiment of the invention, the elastic element axially biases the first and second aerodynamic members 22, 23, an inter-stage sealing device 39 provided between the impeller 17 and the additional impeller 18, the inlet distributor 37 and the bearing sleeve 29 with a predetermined force, for example in the range of 8000 to 10000 N, against the annular axial bearing surface 34 of the bearing casing portion 3.2.

The elastic element allows, notably when a thermal expansion occurs in the centrifugal turbo-compressor 2, an axial sliding of the first and second aerodynamic members 22, 23, the inter-stage sealing device 39, the inlet distributor 37 and the bearing sleeve 29 with respect to the hermetic casing 3, and thus avoids deformations of said parts which could lead to a shortened lifetime of the centrifugal turbo-compressor 2.

The centrifugal turbo-compressor 2 may further includes one or several elastic member(s) axially biasing the first and second axial bearing plates 26, 27 and the spacer ring 28 with a predetermined force, for example in the range of 1000 to 2000 N, against the abutment surface 36 of the bearing sleeve 29. The centrifugal turbo-compressor 2 may for example includes several elastic members located between the first aerodynamic member 22 and the first axial bearing plate 26 and each arranged in a respective through hole provided in the inlet distributor 37. Each elastic member may for example be a coil spring.

The centrifugal turbo-compressor 2 also includes a gas suction inlet 42 provided on the hermetic casing 3, and for example on the bearing casing portion 3.2. According to the embodiment shown on FIGS. 1 to 6, the gas suction inlet 42 includes a gas inlet part 43 having a circular cross section, and a gas outlet part 44 diverging opposite the gas inlet part 43. Advantageously, the gas inlet part 43 extends radially with respect to the longitudinal axis A of the drive shaft 6.

The gas outlet part 44 particularly includes a gas outlet 45 which is oblong and which extends along a circumferential direction with respect to the longitudinal axis A of the drive shaft 6. Advantageously, the gas outlet 45 has a first dimension taken along the longitudinal axis A of the drive shaft 6 and a second dimension taken along the circumferential direction, the second dimension being higher than the first dimension. According to an embodiment of the invention, the first dimension and the second dimension of the gas outlet 45 respect the following equation:

$Do2*Do1>D1^2$, where D1 is the inlet diameter of the gas suction inlet 42, which particularly corresponds to the inner diameter of the gas inlet part 43, Do1 is the first dimension of the gas outlet 45 and Do2 is the second dimension of the gas outlet 45.

Furthermore, the centrifugal turbo-compressor 2 includes a gas flow path P fluidly connected to the gas suction inlet 42 and configured to supply the first compression stage, and particularly the impeller 17, with a gas flow. The gas flow path P is schematically shown on FIG. 1.

The gas flow path P includes a relaxation chamber 46 extending around the drive shaft 6. The gas suction inlet 42, and particularly the gas outlet part 44, emerges radially into the relaxation chamber 46. As better shown on FIG. 4, the relaxation chamber 46 has an axial length L which is higher than the inlet diameter D1 of the gas suction inlet 42. Advantageously, the relaxation chamber 46 has an outer diameter OD and an inner diameter ID which respect the following equation:

$$OD^2-ID^2>2*D1.$$

According to the embodiment shown on FIGS. 1 to 6, the relaxation chamber 46 is defined by the hermetic casing 3, and for example by the bearing casing portion 3.2, and extends around the drive shaft 6 along an angular sector lower than 360°.

Advantageously, the relaxation chamber 46 has a horse-shoe-shaped cross sectional profile. To this end, the hermetic casing 3, and particularly the bearing casing portion 3.2, includes an annular volume 47 partially defining the relaxation chamber 46 and a separating wall part 48 located within the annular volume 47 and opposite the gas suction inlet 42, the separating wall part 48 being configured such that the relaxation chamber 46 includes a first arcuate chamber part 46.1 extending from the gas suction inlet 42 to the separating wall part 48 and a second arcuate chamber part 46.2 extending from the gas suction inlet 42 to the separating wall part 48. The first and second arcuate chamber parts 46.1, 46.2 extend on both side of the longitudinal axis A of the drive shaft 6.

The gas flow path P further includes a connecting channel 49 extending around the drive shaft 6 and coaxially to the longitudinal axis A of the drive shaft 6. The connecting channel 49 is annular and is fluidly connected to the relaxation chamber 46. Advantageously, the connecting channel 49 emerges into the relaxation chamber 46 at an outer radial portion of the relaxation chamber 46 so as to define a flow restriction for the gas flow, and particularly an annular flow restriction.

According to the embodiment shown on FIGS. 1 to 6, the connecting channel 49 has an inner diameter Di which is higher than the inner diameter ID of the relaxation chamber 46, and an outer diameter Do which is equal to the outer diameter OD of the relaxation chamber 46.

The gas flow path P further includes a plurality of inlet flow guide channels 51 fluidly connected to the relaxation chamber 46 via the connecting channel 49. The inlet flow guide channels 51 are regularly angularly distributed around the longitudinal axis A of the drive shaft 6, and have advantageously substantially identical widths. The inlet flow guide channels 51 extend radially towards the drive shaft 6 and are axially offset from the gas suction inlet 42 and the relaxation chamber 46. Particularly, the inlet flow guide channels 51 extend in a same extension plane which is perpendicular to the longitudinal axis A of the drive shaft 6 and which is axially offset from the central axis of the gas suction inlet 42.

Figure 5:
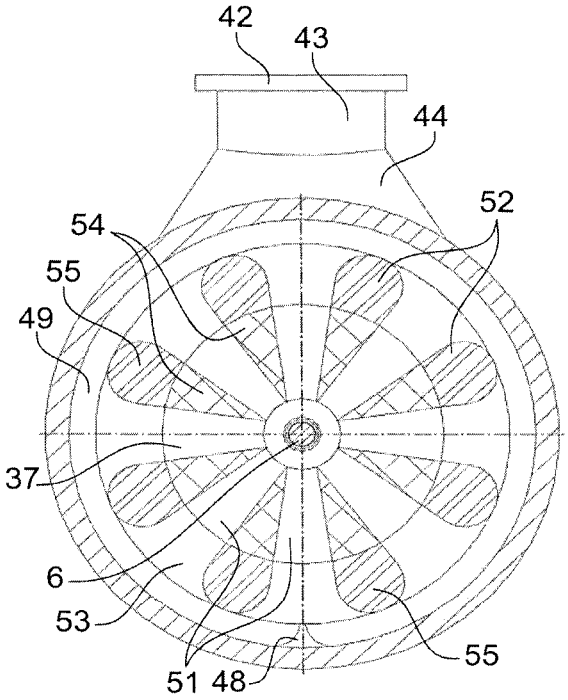
FIGS. 5 and 6 are cross section views of the centrifugal turbo-compressor of FIG. 1.
Figure 6:
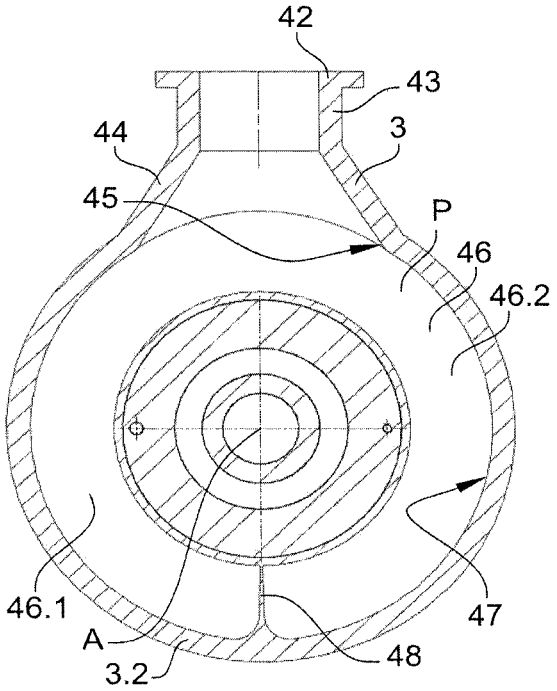

As better shown on FIG. 5, the centrifugal turbo-compressor 2 includes inlet flow guide members 52 partially defining the inlet flow guide channels 51 and being regularly angularly distributed around the longitudinal axis A of the drive shaft 6. Particularly, the inlet flow guide members 52 are arranged such that each pair of adjacent inlet flow guide members 52 defines a respective inlet flow guide channel 51. According to the embodiment shown on FIGS. 1 to 6, each of the inlet flow guide members 52 extends radially towards the drive shaft 6 and converges towards the drive shaft 6. Advantageously, each inlet flow guide member 52 has an airfoil-shaped cross-sectional profile, and includes a leading edge having a high radius of curvature and a trailing tip oriented towards the drive shaft 6. Each inlet flow guide member 52 may have a constant height.

As better shown on FIG. 5, one of the inlet flow guide channels 51 is located at a same angular position as the separating wall part 48 while being axially offset from the separating wall part 48.

According to the embodiment shown on FIGS. 1 to 6, each inlet flow guide member 52 is partially defined by the inlet distributor 37 and by a stationary flow guiding part 53 having an annular disc shape, the stationary flow guiding part 53 surrounding the inlet distributor 37 and being clamped between the impeller casing portion 3.1 and the bearing casing portion 3.2.

Particularly, the inlet distributor 37 includes inlet flow guide elements 54 extending radially towards the drive shaft 6 and projecting from an axial surface of the inlet distributor 37 facing towards the impeller 17, and the stationary flow guiding part 53 also includes inlet flow guide portions 55 projecting from an axial surface of the stationary flow guiding part 53 facing towards the impeller 17. Each inlet flow guide element 54 is particularly angularly aligned with a respective inlet flow guide portion 55 so as to define a respective inlet flow guide member 52.

According to the embodiment shown on FIGS. 1 to 6, the connecting channel 49 is defined by the stationary flow guiding part 53 and by the hermetic casing 3, and the connecting channel 49 is configured so as to respect the following equation:

$\pi*H*Di<\pi/4*(Do^2-Di^2)$, where H is the height of each inlet flow guide member 52 (which corresponds to the dimension of each inlet flow guide channel 51 taken along the longitudinal axis A), Di is the inner diameter of the connecting channel 49 and Do is the outer diameter of the connecting channel 49.

The gas flow path P further includes an annular supplying channel 56 fluidly connected to the inlet flow guide channels 51, and configured to axially supply the impeller 17 with the gas flow. Advantageously, the annular supplying channel 56 extends around the drive shaft 6 and is internally defined by an annular converging surface 57 which converges towards the impeller 17. According to the embodiment shown on FIGS. 1 to 6, the annular converging surface 57 is provided on a covering part 58 which is secured to the inlet distributor 37, the covering part 58 extending around the drive shaft 6 and being configured such that the gas flow flowing from the inlet flow guide channels 51 to the impeller 17 does not contact a rotational part, and for example the drive shaft 6.

During operation of the centrifugal turbo-compressor 2, a gas flow, flowing out the gas suction inlet 42, comes radially into the relaxation chamber 46, and then flows at low speed in the first and second arcuate chamber parts 46.1, 46.2 before entering the connecting channel 49. The gas flow coming out of the connecting channel 49 enters the inlet flow guide channels 51 and flows radially through the inlet flow guide channels before being axially supplied to the impeller 17 via the annular supplying channel 56.

Such a configuration of the gas flow path and of the gas suction inlet substantially minimizes the pressure losses at the inlet of the gas flow path and substantially minimizes the flow distortions through the inlet flow guide channels. This results in a more homogenous flow distribution along a circumferential direction at the fluid inlet of the first impeller, and thus substantially improves the compressor efficiency, while enabling an easy manufacturing of the turbo-compressor.

Figure 7:
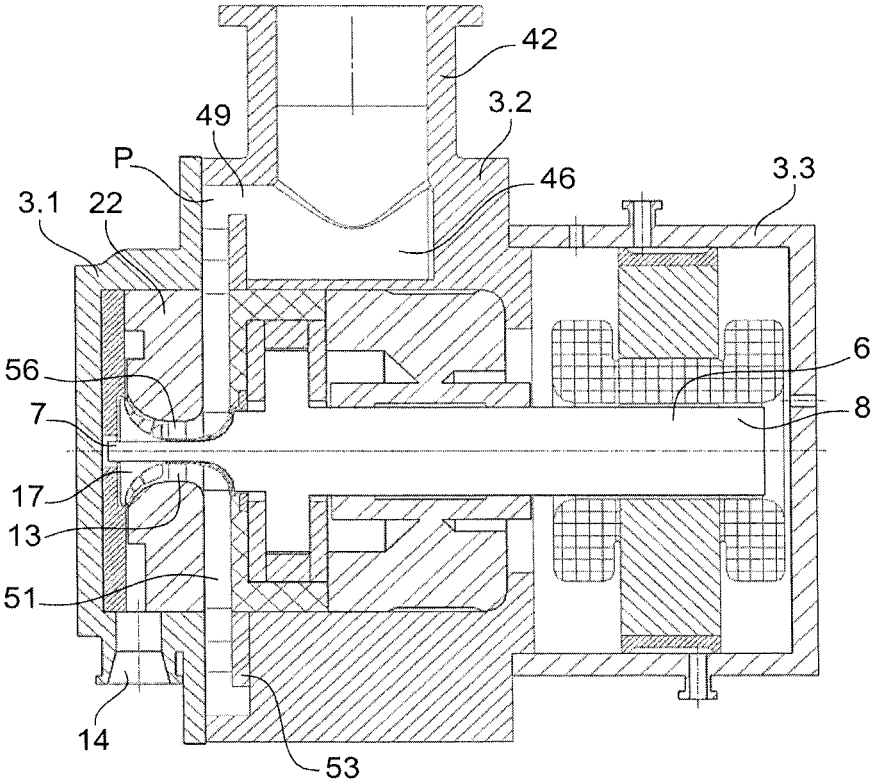
FIG. 7 is a longitudinal section view of a centrifugal turbo-compressor according to a second embodiment of the invention.

FIG. 7 represents a single-stage hermetic centrifugal turbo-compressor 2 according to a second embodiment of the invention which differs from the first embodiment essentially in that it includes only compression stage, and thus one impeller 17 and one aerodynamic member 22.

Of course, the invention is not restricted to the embodiment described above by way of non-limiting examples, but on the contrary it encompasses all embodiments thereof.

What is claimed is:

1. A centrifugal turbo-compressor including:

a hermetic casing, a drive shaft having a longitudinal axis (A) and rotatably arranged within the hermetic casing, a compression stage including an impeller connected to the drive shaft, a gas suction inlet, a gas flow path (P) fluidly connected to the gas suction inlet and configured to supply the compression stage with a gas flow, wherein the gas flow path (P) includes:

a relaxation chamber at least partially surrounding the drive shaft, the gas suction inlet emerging substantially radially into the relaxation chamber, and a plurality of inlet flow guide channels fluidly connected to the relaxation chamber and angularly distributed around the longitudinal axis (A) of the drive shaft, the plurality of inlet flow guide channels extending radially towards the drive shaft and being axially offset from the gas suction inlet and the relaxation chamber, wherein the gas suction inlet and the relaxation chamber are configured with respect to the following equation: $OD^2-ID^2>2*D1$, where:

OD is an outer diameter of the relaxation chamber taken in a radial direction to the longitudinal axis (A);

ID is an inner diameter of the relaxation chamber taken in the radial direction to the longitudinal axis (A); and D1 is an inlet diameter of the gas suction inlet taken in an axial direction along the longitudinal axis (A).

2. The centrifugal turbo-compressor according to claim 1, wherein the relaxation chamber extends around the drive shaft along an angular sector less than 360°.

3. The centrifugal turbo-compressor according to claim 2, further including a separating wall part located opposite the gas suction inlet and configured such that the relaxation chamber includes a first arcuate chamber part extending from the gas suction inlet to the separating wall part along a first angular direction with respect to the longitudinal axis (A) of the drive shaft and a second arcuate chamber part extending from the gas suction inlet to the separating wall part along a second angular direction with respect to the longitudinal axis (A) of the drive shaft which is opposite of the first angular direction.

4. The centrifugal turbo-compressor according to claim 1, wherein the relaxation chamber has a horseshoe-shaped cross sectional profile.

5. The centrifugal turbo-compressor according to claim 1, wherein an axial length (L) of the relaxation chamber is greater than an inlet diameter (D1) of the gas suction inlet.

6. The centrifugal turbo-compressor according to claim 1, wherein the gas flow path (P) further includes a connecting channel extending around the drive shaft and fluidly connecting the relaxation chamber with the plurality of inlet flow guide channels.

7. The centrifugal turbo-compressor according to claim 6, wherein the connecting channel emerges into the relaxation chamber at an outer radial portion of the relaxation chamber so as to define a flow restriction for the gas flow.

8. The centrifugal turbo-compressor according to claim 6, wherein the connecting channel is annular.

9. The centrifugal turbo-compressor according to claim 1, further including inlet flow guide members at least partially defining the plurality of inlet flow guide channels, the inlet flow guide members being angularly distributed around the longitudinal axis (A) of the drive shaft.

10. The centrifugal turbo-compressor according to claim 9, wherein each of the inlet flow guide members extends radially towards the drive shaft and converges towards the drive shaft.

11. The centrifugal turbo-compressor according to claim 1, further including an inlet distributor having an annular disc shape and surrounding the drive shaft, the plurality of inlet flow guide channels being at least partially defined by the inlet distributor.

12. The centrifugal turbo-compressor according to claim 1, wherein the gas flow path (P) further includes an annular supplying channel extending around the drive shaft and being fluidly connected to the plurality of inlet flow guide channels, the annular supplying channel being configured to axially supply the compression stage with the gas flow.

13. The centrifugal turbo-compressor according to claim 1, wherein the gas suction inlet includes a gas inlet part having a circular cross section, and a gas outlet part including a gas outlet emerging into the relaxation chamber, the gas outlet part diverging towards the relaxation chamber.

14. The centrifugal turbo-compressor according to claim 2, wherein the relaxation chamber has a horseshoe-shaped cross sectional profile.

15. The centrifugal turbo-compressor according to claim 2, wherein an axial length (L) of the relaxation chamber is greater than an inlet diameter (D1) of the gas suction inlet.

16. The centrifugal turbo-compressor according to claim 3, wherein an axial length (L) of the relaxation chamber is greater than an inlet diameter (D1) of the gas suction inlet.

17. The centrifugal turbo-compressor according to claim 4, wherein an axial length (L) of the relaxation chamber is greater than an inlet diameter (D1) of the gas suction inlet.

18. The centrifugal turbo-compressor according to claim 6, further including inlet flow guide members at least partially defining the plurality of inlet flow guide channels, the inlet flow guide members being angularly distributed around the longitudinal axis (A), wherein the connecting channel is configured with respect to the following equation: $\pi*H*Di<\pi/4*(Do^2-Di^2)$, where:

H is a height of each inlet flow guide member of the inlet flow guide members taken in an axial direction along the longitudinal axis (A);

Di is an inner diameter of the connecting channel taken in the radial direction to the longitudinal axis (A); and Do is an outer diameter of the connecting channel taken in the radial direction to the longitudinal axis (A).

19. The centrifugal turbo-compressor according to claim 11, wherein the inlet distributor is slidably arranged in the axial direction along the longitudinal axis (A).

* * * * *